US005342104A

United States Patent [19]

Sato et al.

[11] Patent Number: 5,342,104

[45] Date of Patent: Aug. 30, 1994

[54] AUTOMATIC LIFTING ANGLE ADJUSTER FOR LIFTING WIRE ROPE

[75] Inventors: Masanori Sato, Kawachinagano; Kazuyoshi Goto, Kitakyushu; Katsuyuki Hiyama, Hikari; Yoshinobu Chaen, Sakai, all of Japan

[73] Assignee: Sankyu Inc., Kitakyushu, Japan

[21] Appl. No.: 18,795

[22] Filed: Feb. 16, 1993

Related U.S. Application Data

[62] Division of Ser. No. 690,888, Jul. 23, 1991, Pat. No. 5,207,795.

[30] Foreign Application Priority Data

Oct. 16, 1989 [JP] Japan ..... 1-122533
Apr. 20, 1990 [JP] Japan ..... 2-42870

[51] Int. Cl.[5] ..... B66C 1/12

[52] U.S. Cl. ..... 294/74; 294/81.21; 294/81.55

[58] Field of Search ..... 294/74, 81.1, 81.2, 294/81.21, 81.55

[56] References Cited

FOREIGN PATENT DOCUMENTS 54-144654 11/1979 Japan ..... 294/74
55-34116 9/1980 Japan ..... 294/74
59-26888 2/1984 Japan ..... 294/81.21
231795 9/1989 Japan ..... 294/74

*Primary Examiner*—Dean J. Kramer
*Attorney, Agent, or Firm*—Armstrong, Westerman, Hattori, McLeland & Naughton

[57] ABSTRACT

An automatic lifting angle adjuster for lifting wire rope having expandable arm members 12 which are connected to an expanding driving device 11 at the center thereof and a fixing device 21 which is attached to the top end portion of each arm member 12, and provided with rope-fixing member 23 each of which fixes a wire rope 20, rope guide members 24 through each of which the wire rope 20 passes and tension springs 25 each of which connects each of them, wherein the rope guide member 24 is rotated inside and outside of arm member 12 for hooking a load to be lifted and for removing by itself from the transported load. And, an automatic lifting angle adjuster for lifting wire rope having an expanding driving device 11 comprising a sliding member 15 which is compressed by a central compression spring 17, a receiving member 18, and a vertical shaft 14 which connects these members, and allowing a simple construction and small height in total size.

3 Claims, 10 Drawing Sheets

AUTOMATIC LIFTING ANGLE ADJUSTER FOR LIFTING WIRE ROPE

This is a continuation of application Ser. No. 07/690,888 filed July. 23, 1991 now U.S. Pat. No. 5,207,795.

BACKGROUND OF THE INVENTION

1. Field of the Invention

The present invention relates to a device for reducing the burden of work to attach and detach a heavy wire rope, that is, a hooking work in lifting a large and heavy load.

2. Background Art

In the case of lifting a large load and transporting it to the designated place, it has been a general practice in the conventional art to hook a load to be lifted with wire ropes by the manpower of a hooking worker and then to hoist the wire ropes by hitching them with the crane hook. However, in the case of lifting a heavy load, there has been a problem that a lot of hooking workers are required, the workability becomes bad, the physical sufferings of the workers become extremely large, and the safety in the work is worsened, because the wire ropes having a large diameter and large weight must be employed in such a work.

To solve such a problem, as disclosed in the Gazette of Japanese Patent Laid-Open 58-144086 and the Gazette of Japanese Patent Laid-Open 59-26888 for example, there has been offered heavy load lifting tackles for adjusting automatically the lifting angle between said hooking wire ropes. Those heavy load lifting tackles have such a construction that plural number of arm members are telescopically expanded for adjustment, a lifting plate to which a lifting wire rope is connected is attached to the top end of each of the arm members, a clamp is hung from the bottom of each lifting plate, the clamp is secured near the periphery of a load to be lifted, and then the sloping angle between said arms is changed corresponding to the lifting angle between said lifting wire ropes. And, as a driver for expanding the arms, weights are used in the former example, and springs are used in the latter.

The heavy load lifting tackles offered in said examples are aimed to make a hooking work safe and easy, and proved a relatively large effect in reducing the burden of the hooking workers. However, even in such devices, in the case of former heavy load lifting tackle in which weights are used, for example, there has been a problem that the device itself becomes a heavy load and difficult to handle because it includes heavy weight.

In the case of the heavy load lifting tackle of the latter example in which springs are used, there has been a large problem that ready-made wire ropes can't be used because the shaft member which supports the springs projects downwards to make the lift of the overall device high. In addition, said lifting tackle has been including a serious obstacle to a practical use that the device itself is heavy, the manufacturing cost is high, and the handling is difficult because the device has a complicated construction.

Further, there have been problems that the clamp which is hung from the lifting plate, though coming near the periphery of the load to be lifted, is easy to swing, with the shackle installed on the lifting plate being a supporting point, and that the clamp once bit the load to be lifted comes off from the load, or the clamp can't be removed automatically from the load after the completion of transportation. These problems become serious especially in hooking a load to be lifted directly with wire rope without using a clamp and, in such a case, the wire rope which is engaging the load to be lifted must be held by a hooking worker when lifting or lowering the crane hook, and it must also be removed from the load by the manpower of a hooking worker. Therefore, a hooking worker has been required to carry out the same work as that in the conventional art, and there has been a limit in reducing the burden of the hooking worker

SUMMARY OF THE INVENTION

The present invention has been made in view of above-mentioned circumstances and, accordingly, it is the first object of this invention to provide an automatic lifting angle adjuster for lifting wire rope, wherein a wire rope is easy to engage a load to be lifted and is semiautomatically removed from the load when the transportation is over.

Further, intending to settle radically the problems in heavy load lifting tackles relating to said conventional arts especially those in the means employing a spring as a driving source, it is the second object of this invention to provide an automatic lifting angle adjuster for lifting wire rope which has a simple construction and is small in total height, which can adjust surely and automatically the lifting angle between the wire ropes in a hooking work and, at the same time, which can improve the work efficiency and reduce the burden of hooking workers.

The automatic lifting angle adjuster for lifting wire rope relating to a first embodiment of the present invention with the first object mentioned above comprises expandable arm members which are connected radially to an expanding driving means disposed at the center thereof and fixing means each of which is placed at the top end portion of each arm member so as to fix a lifting wire rope, by which the opening angle between the arm members is increased at the time of hooking work and the opening angle between the arm members is decreased at the time of lifting, wherein each of said fixing means comprises a rotation shaft which is installed horizontally at the top end portion of each of said arm members, a rope-fixing member having a supporting shaft which meets said rotation shaft at right angles and a fixing jig for fixing said wire rope at the upper end portion thereof, and being rotatably supported by said rotation shaft, a rope guide member which is swingably supported by said supporting shaft and grips said wire rope inserted therein under said rope-fixing member, and a tension spring which connects said rope-fixing member and said rope guide member by a predetermined tension, being hitched at the top or mid portion thereof.

In the case of automatic lifting angle adjuster for lifting wire rope relating to the present invention, since the rope-fixing member is attached to the rotation shaft which is installed horizontally at the top end portion of each of arm members, the rope-fixing member is provided with the supporting shaft which meets said rotation shaft at right angles, the supporting shaft is provided with the rope guide member, and the top portion of the rope guide member and the top or mid portion of the rope-fixing member are connected with the tension spring, it is possible to swing the rope guide member, with the supporting shaft being a supporting point, and hold it inside or outside the device. Therefore, in case of lifting a load by use of wire ropes, each wire rope hooks the load to be lifted while the rope guide member being bent inside, with the supporting shaft being a supporting point and, when the top end of said wire ropes are lifted by the crane hook, the wire ropes become straight and, therefore, the rope-fixing member rotates, with the rotation shaft being a supporting point, the rope guide member swings, with said supporting shaft being a supporting point and becomes in line with the axis of the am member. And, when the lifted load is transported to a designated place and the crane hook is lowered to lose the force to lift the wire ropes, the am members are expanded by the force of the expanding driving means. Accompanying this action, the rope guide member is bent outside by the force of tension spring, with the supporting shaft being a supporting point and, as a result, the wire ropes come off automatically from the load to be lifted. Thus, the wire ropes are removed from the load to be lifted without troubling the hooking workers.

The automatic lifting angle adjuster for lifting wire rope relating to another embodiment of the present invention with said first object comprises expandable am members which are connected radially to an expanding driving means disposed at the center thereof and fixing means each of which is placed at the top end portion of each am member so as to fix a lifting wire rope, by which the opening angle between the arm members is increased at the time of hooking work and the opening angle between the arm members is decreased at the time of lifting, wherein each of said fixing means comprises a rotation shaft which is installed horizontally at the top end portion of each of said arm members, a rope-fixing member having a fixing jig for fixing said wire rope at the upper end portion thereof and being rotatably supported by said rotation shaft, a rope guide member having a supporting bracket which is rotatably supported by said rotation shaft, being fixed in the inverse direction of said rope-fixing member, and gripping said wire rope inserted therein while swinging under said rope-fixing member, and a tension spring which connects said rope-fixing member and said rope guide member by a predetermined tension, being hitched at the top or mid portion thereof.

Therefore, in the case of automatic lifting angle adjuster for lifting wire rope relating to said second invention, each wire rope is hooked to a load to be lifted, with the rope guide member disposed opposite the rope-fixing member being held inside from the top end portion of each arm member by the force of tension spring and, when the load is lifted by the crane hook together with the adjuster and the wire ropes, each wire rope becomes straight in lifting the load. By this action, the rope guide member rotates outside, with the rotation shaft being a supporting point, and the rope guide member is pulled in the inverse direction by the force of tension spring and held there. And, when the crane hook is lowered to lose the force to lift the wire ropes at a designated place, the arm members are expanded by the force of expanding driving means, and the rope guide member is bent outside by the force of tension spring and keeps that state there and, as a result, the wire ropes come off automatically from the load to be lifted. Thus, the wire ropes are removed from the load to be lifted without troubling the hooking workers.

In the cases of said first and second embodiments, the expanding driving means for expanding the arm members includes the one in which weights are used other than those in which springs are used.

And, the automatic lifting angle adjuster for lifting wire rope relating to a third embodiment of the present invention with said second object comprises expandable arm members which are connected radially to an expanding driving means disposed at the center thereof and fixing means each of which is placed at the top end portion of each arm member so as to fix a lifting wire rope, by which the opening angle between the arm members is increased at the time of hooking work and the opening angle between the arm members is decreased at the time of lifting, wherein said expanding driving means comprises a sliding member having lower brackets to each of which each base end of said radially-projecting arm members is rotatably attached and holding a vertical through shaft at the center thereof, a receiving member having upper brackets disposed in the same direction as that of lower brackets attached to said sliding member, holding said vertical shaft at the center thereof and, at the same time, being disposed above said sliding member via a compression spring inserted through and held by the vertical shaft, and a linking member which connects each of the upper brackets of said receiving member and each of said arm members at the predetermined position.

In the case of automatic lifting angle adjuster for lifting wire rope relating to the third embodiment, the hook of each wire rope which is hung from the crane hook can be placed at the predetermined hooking position just before a hooking work. By this mechanism, the hook of wire rope can be hooked to a load to be lifted easily and in a short time and, when the crane hook is lifted, and the weight of load to be lifted is applied to the rope, the lifting angle adjuster changes the angle between wire ropes automatically accompanying the change in the lifting angle, preventing an overload from being applied to the component members of the lifting angle adjuster.

DESCRIPTION OF THE PREFERRED EMBODIMENTS

Figure 1:
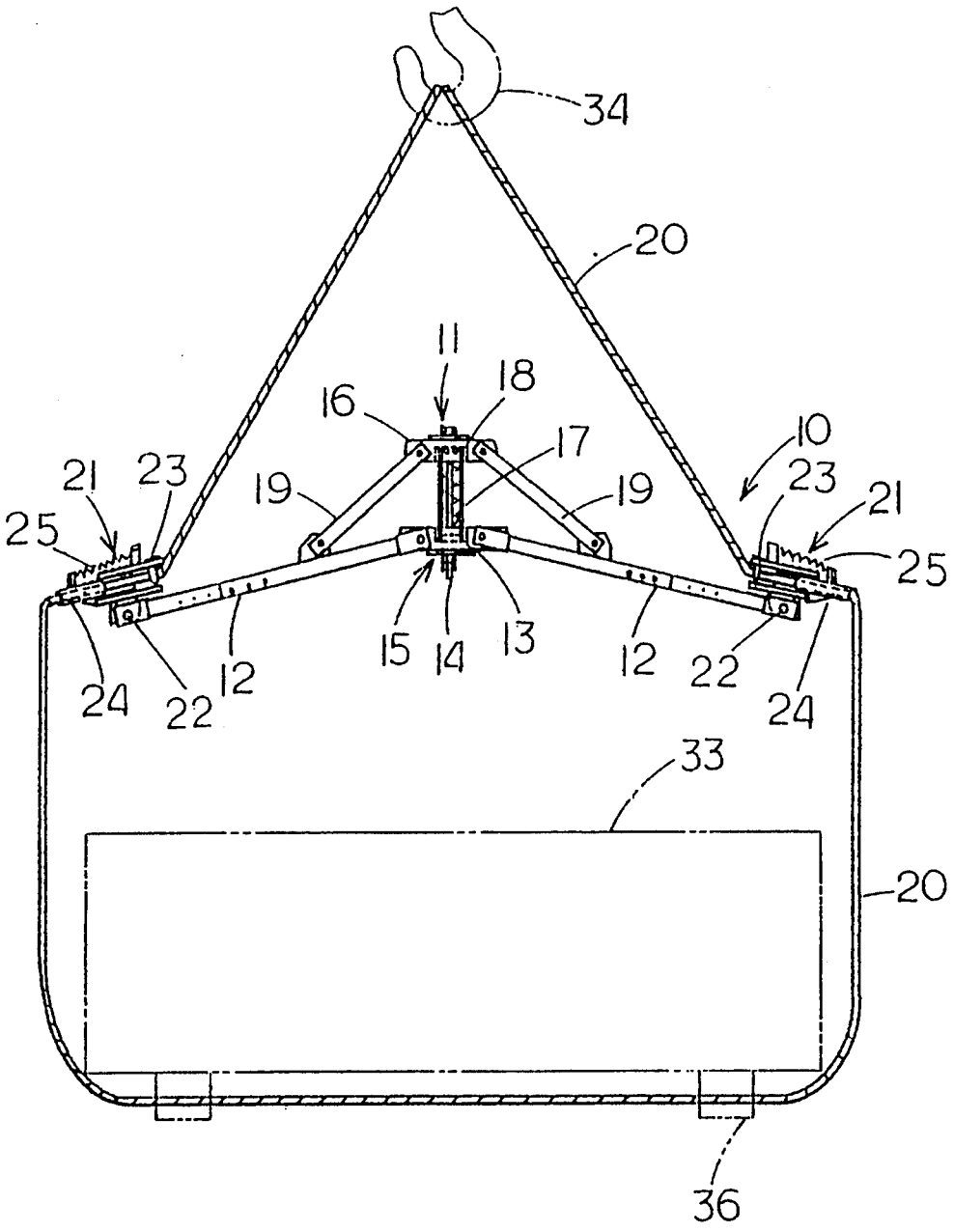
FIG. 1 is a front view of the automatic lifting angle adjuster for lifting wire rope relating to the first embodiment of this invention.
Figure 2:
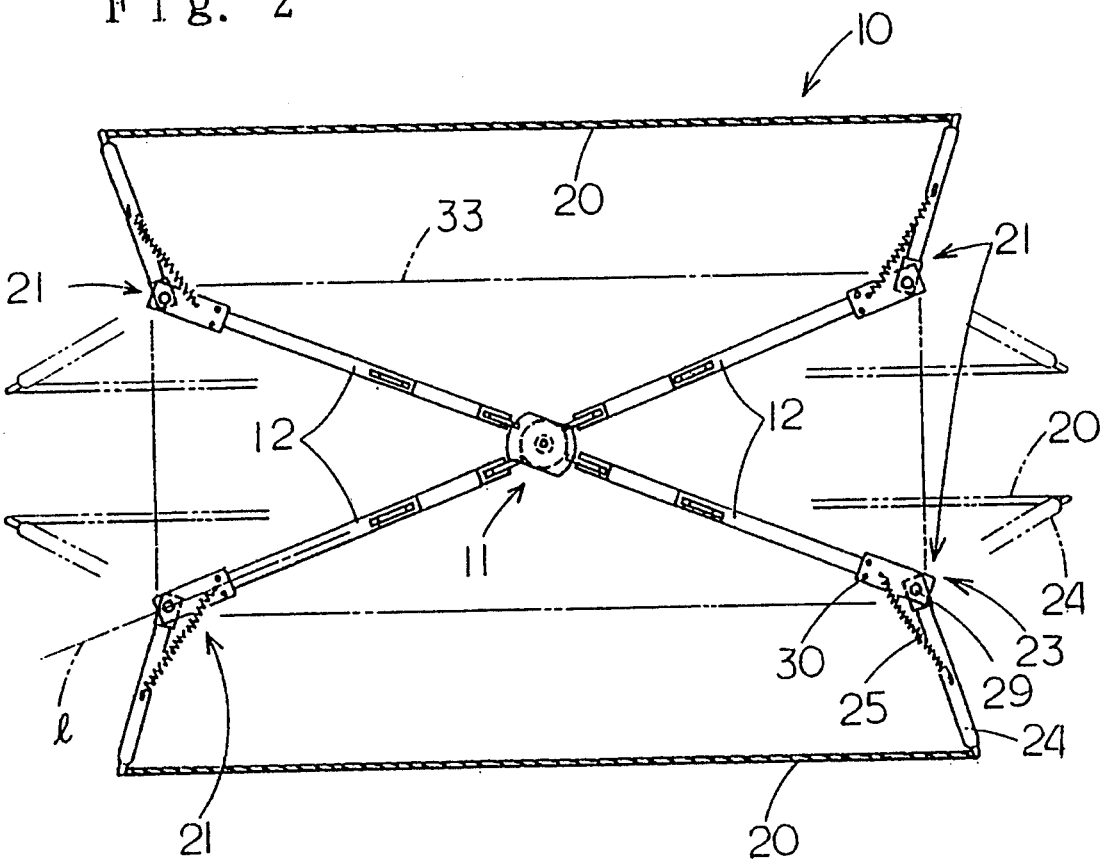
FIG. 2 is a plan view of the same.

Referring to FIG. 1 and FIG. 2 showing one embodimemt of the lifting angle adjuster relating to the first embodimemt of this invention, the number 10 in the figure shows an automatic lifting angle adjuster for lifting wire rope (simply referred to as a lifting angle adjuster hereinbelow), the number 11 shows an expanding driving means disposed at the center of the lifting angle adjuster 10, and the number 12 shows an expandable arm member.

The expanding driving means 11 of this embodiment comprises a sliding member 15 having radially-projecting four lower brackets 13 and holding a vertical through shaft 14 at the center thereof, a receiving member 18 having upper brackets 16 disposed in the same direction as that of lower brackets 13 which are attached to said sliding member 15, holding said vertical shaft 14 at the center thereof and, at the same time, being disposed above said sliding member 15 via a compression spring 17 inserted through and held by the vertical shaft 14, and four linking members 19 each of which connects each of the upper brackets 16 of said receiving member 18 and each of said arm members 12 at the predetermined position.

Then, the arm members 12 are expanded by the spring force, which is transmitted via the linking member 19, of the compression spring 17 disposed at the center of lifting angle adjuster 10. Thus, the expanading driving means 11 in which the linking member 19 and the compression spring 17 are used as disclosed in this embodiment has a more simple construction than that of prior art and, because the total height of the device is small, allows a high lift to the crane.

Said arm members 12 are supported by the lower brackets 13 in such a manner that the base end of each arm member may rotate, expanded radially in four directions from said expanding driving means 11, and have a design to be telescopically extracted and retracted. At the top end portion of am member 12, there is provided a fixing means 21 to fix the wire rope 20.

Figure 3:
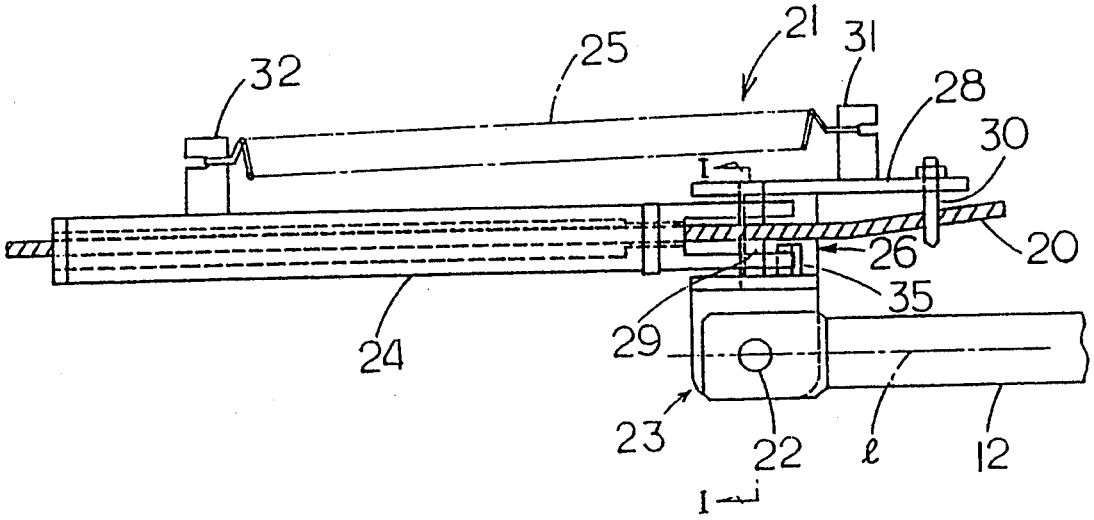
FIG. 3 is a side view showing the details of the fixing means of said automatic lifting angle adjuster for lifting wire rope.
Figure 4:
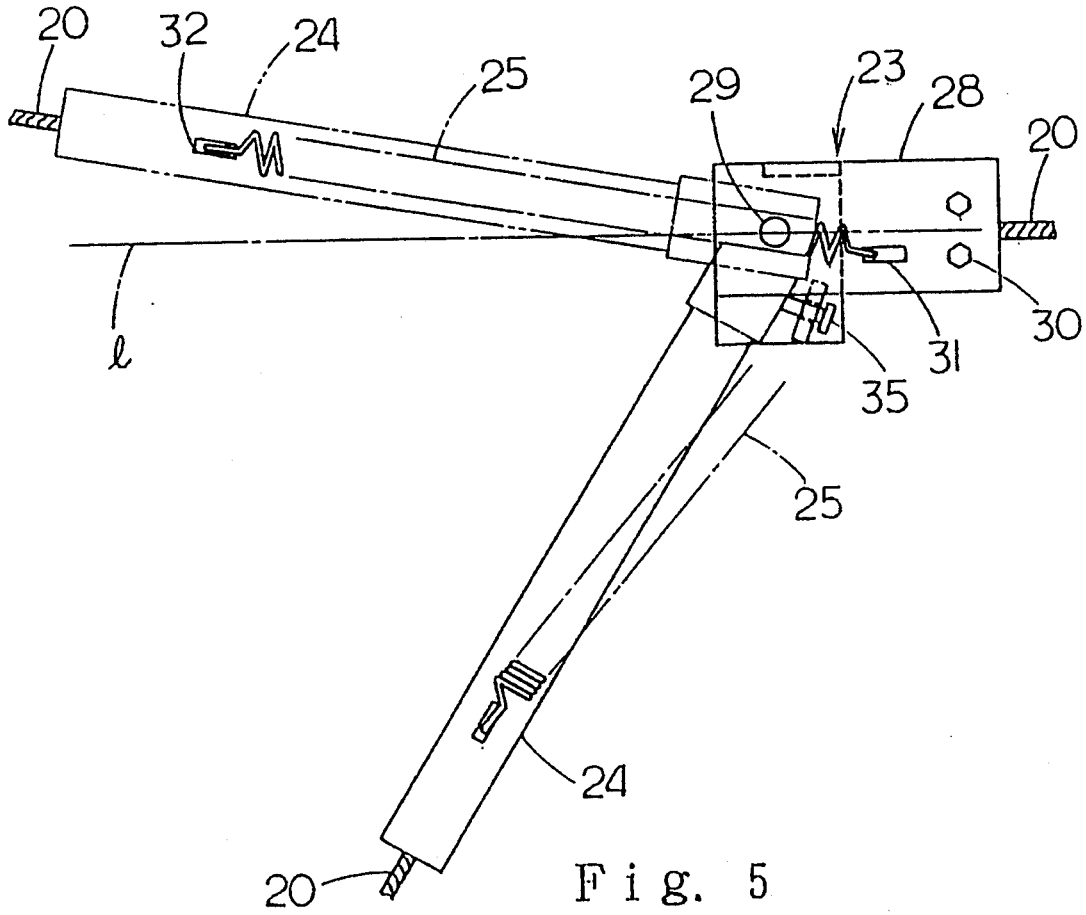
FIG. 4 is a plan view of the same.
Figure 5:
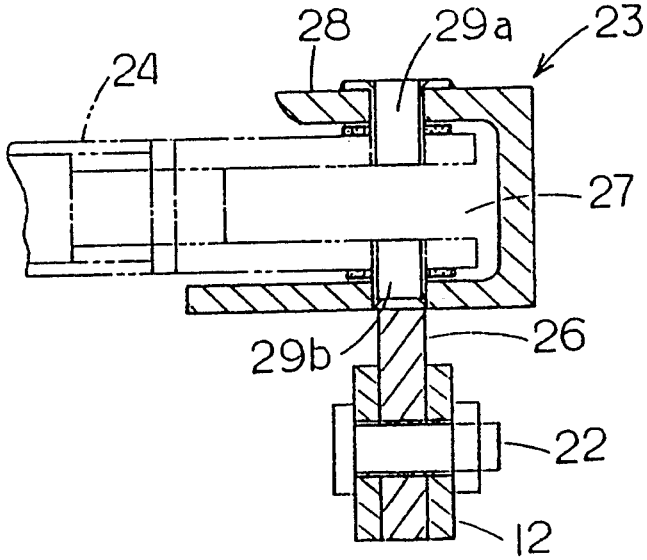
FIG. 5 is a sectional view on line I—I of FIG. 3.

The fixing means 21, as shown in the side view FIG. 3, in the plan view FIG. 4, and in the sectional view FIG. 5 (sectional view on line I—I of said FIG. 3), comprises a rotation shaft 22 which is installed in right angles to the axis l of said am members 12, a rope-fixing member 23 which is rotatably supported by this rotation shaft 22, a cylindrical rope guide member 24 which grips the wire rope 20 inserted therein under the rope-fixing member 23, and a tension spring 25 which connects said rope-fixing member 23 and said rope guide member 24 by a predetermined tension, being hitched at the end portion thereof.

The rope-fixing member 23 is provided with a bracket 26 which is supported by said rotation shaft 22 and a supporting member 28 which is fixed to this bracket 26 while forming a space 27 for inserting the wire rope, and the supporting member 28 is provided with a supporting shaft 29 which meets in right angles to said rotation shaft 22 and, at the top end portion thereof, there is provided a fixing jig 30 which secures the wire rope 20 to the supporting member 28. Here the fixing jig 30 may be a well-known clip for example.

To the supporting shaft 29, said rope guide member 24 is swingably attached so as to guide thereunder the wire rope 20 which is inserted through said space 27 for inserting the wire rope.

Therefore, it is preferable to divide said supporting shaft 29 into upper and lower halves (29 a and 29 b) as shown in FIG. 5 so as to enable an effective insertion of wire rope 20. It is of course acceptable to provide the supporting shaft 29 in the manner it project out of the rope guide member 24 and, to said supporting member 28, provide a hole for holding the supporting shaft 29.

At the top portion (including the mid portion) of the rope-fixing member 23, there is provided a hitching jig 31 which hitches said tension spring 25 and, at the top portion (including the mid portion) of the rope guide member 24, there is also provided a hitching jig 32. By the hitching jigs 31 and 32, the tension spring 25 is hitched so as to pull constantly the rope guide member 24 to the rope fixing member 23 at a predetermined tension.

Then, the action of this fixing means 21 is explained as in the case of lifting a rectangular box type load 33 to be lifted for example.

Two pairs of wire ropes 20 which can engage the load 33 to be lifted fully in the longitudinal direction are hung from the crane hook 34. The lifting angle adjuster 10 is secured in the middle of said wire rope 20 by fixing above-portion described rope-fixing member 23 to the wire rope via the fixing jig 30. Thus, just before hooking the load to be lifted, the rope guide member 24 is bent to the outside by the tensile force of the tension spring 25 as shown with the solid line in FIG. 2 and FIG. 4, and the wire rope 20 is put to the outside of the periphery of the load 33 to be lifted.

Then, with its top end portion being pushed inside, the rope guide member 24 rotates, with the supporting shaft 29 as a supporting point and, by the tensile force of the tension spring 25, it is bent to the inside of the axis of the arm member 12 as shown with two-dot chain line in FIG. 2 and FIG. 4, and then the wire rope 20 is shifted to the lifting position of the load 33 to be lifted. Here, the number 35 shows a stopper which is provided to the rope-fixing member 23 so as to prevent said rope guide member 24 from swinging over the predetermined amount.

Thus, the wire rope 20 which passed through from said space 27 for inserting the wire rope of the rope-fixing member 23 to the inner portion of the rope guide member 24 is bound around the load 33 to be lifted at its side end portion which is the lifting position thereof and, by the force of said tension spring 25, the wire rope keeps this state steadily. This work to engage the wire rope, that is, a hooking work can easily be carried out by one hooking worker only by pushing and bending the top end portion of the rope guide member 24 to the inside.

When the hooking work is completed, the crane hook 34 is lifted to start lifting. By the action to lift the crane hook 34, the opening angle between the arm members 12 is decreased and, according to the lifting angle, the wire rope 20 becomes straight. At this time, the rope-fixing member 23 rotates, with the rotation shaft 22 as a supporting point so as to follow smoothly the opening angle between the arm members 12. The rope guide member 24 also swings, with the supporting shaft 29 as a supporting point and almost coincides with the axis l of the arm member 12.

When the load 33 to be lifted is transported to the predetermined place and put on pillow metals 36 for example, and the wire rope 20 loses the lifting force, the angle between the arm members 12 is increased by the driving force of the expanding driving means 11.

Accompanying this action, the rope guide member 24 is bent to the outside by the force of the tension spring 25, and then the wire rope 20 comes off automatically from the load 33 to be lifted. Thus, the wire rope 20 can be removed from the load 33 to be lifted without troubling a hooking worker.

Here, to obtain an effective action of above-described tension spring 25, it is preferable to dispose the hitching jig 31 for hitching the tension spring 25 at the outside of the axis l of the arm member 12 as shown in FIG. 4. As a result of disposing the hitching jig at such a position, the rope guide member 24 which is in line with the axis E of the arm member 12 at the time of being lifted is pulled to the outside by the force of tension spring 25 and, when the wire rope 20 loses the lifting force, the rope guide member 24 swings to the outside automatically.

Figure 6:
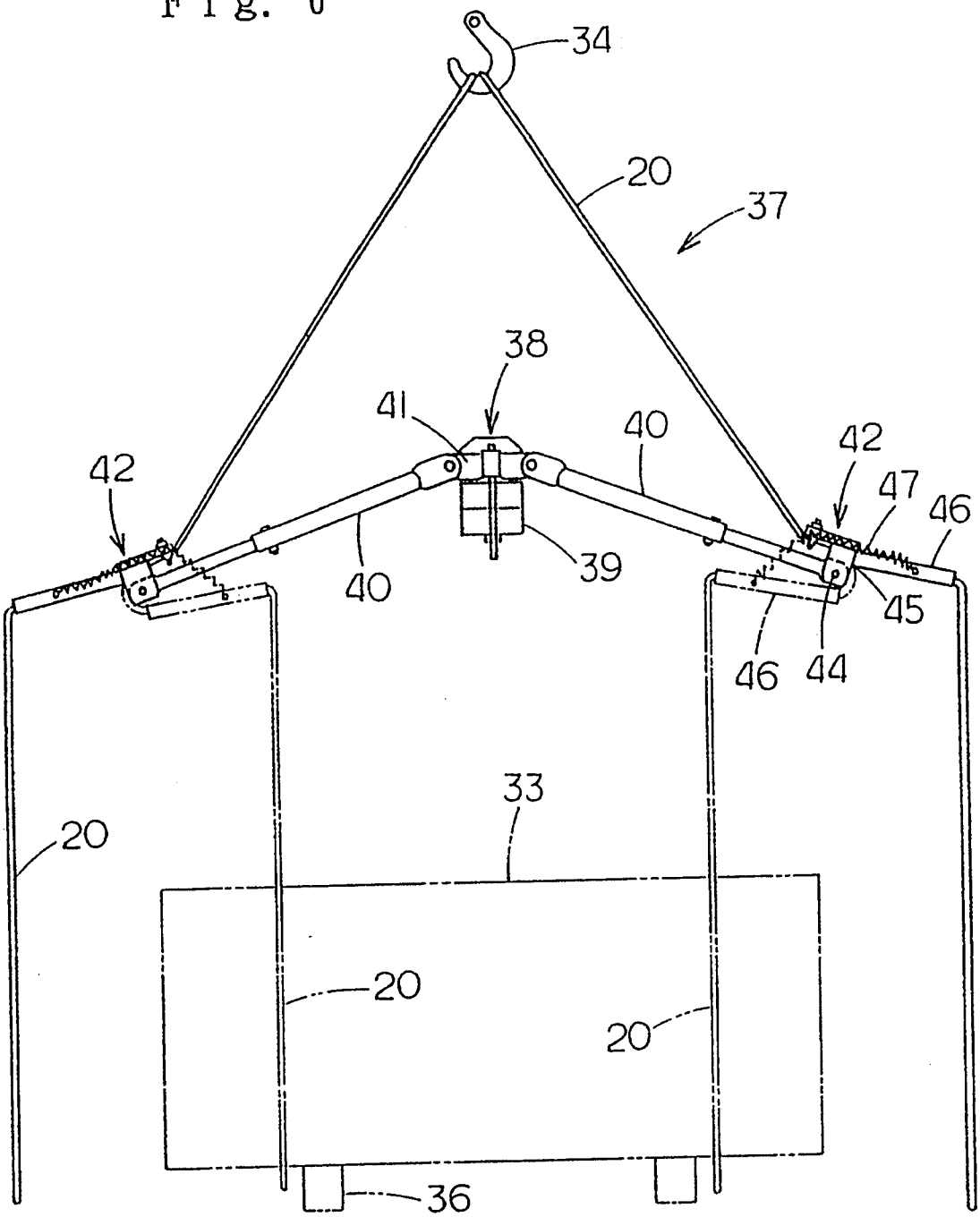
FIG. 6 is a front view of the automatic lifting angle adjuster for lifting wire rope relating to the second embodiment of this invention.
Figure 7:
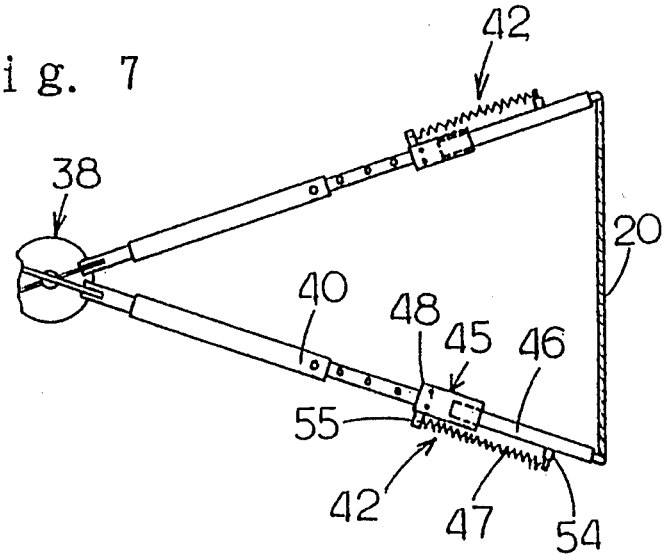
FIG. 7 is a partial plan view of the same.

Then, referring to FIG. 6 and FIG. 7 showing an automatic lifting angle adjuster for lifting wire rope (referred to simply as a lifting angle adjuster hereinbelow) relating to the second embodimemt of this invention, the number 37 in the figure shows a lifting angle adjuster according to this invention, the number 38 shows an expanding driving means disposed at the center of the lifting angle adjuster 37 wherein weights 39 are used, and the number 40 shows an expandable arm members which are supported by four brackets 41 projectingly provided above said weights 39 and expand radially in four directions from said expanding driving means 38. At the top end portion of the arm members 40, there is provided a fixing means 42 which fixes the wire rope 20.

Figure 8:
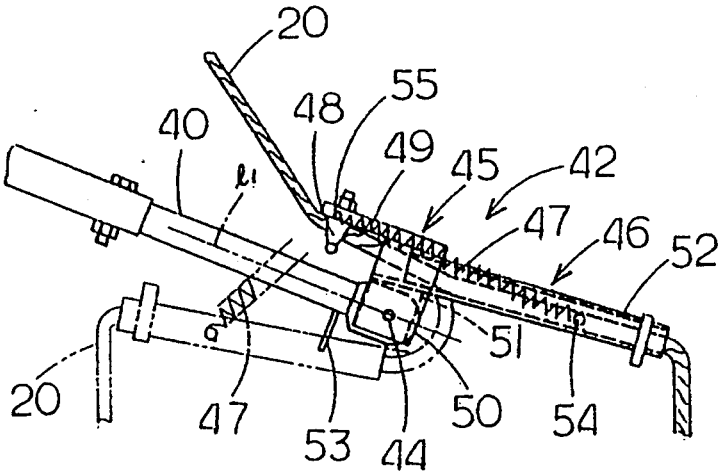
FIG. 8 is a partially enlarged side view of the fixing means of the automatic lifting angle adjuster for lifting wire rope relating to said embodiment.

The fixing means 42 of this embodiment comprises a rotation shaft 44 which is installed at the top end portion of each of said arm members 40 as shown in FIG. 7 and in the partial enlarged view FIG. 8, a rope-fixing member 45 which is rotatably supported by the rotation shaft 44, a rope guide member 46 which is rotatably supported by the rotation shaft 44 and rotates under said rope-fixing member 45, and a tension spring 47 which connects the rope-fixing member 45 and the rope guide member 46 by a predetermined tension, being hitched at the top portion thereof.

The rope-fixing member 45 is made up, in L-shape, with a supporting member 49 having, on its top end portion, a fixing jig 48 for fixing the wire rope 20 and a bracket 50 which is rotatably supported by said rotation shaft 44, and is fixed to the wire rope 20 via said fixing jig 48 above the place where the rotation shaft 44 is installed.

The rope guide member 46 comprises a supporting bracket 51 which is rotatably supported by the rotation shaft and rotates under said rope-fixing member 45, and a rope guide cylinder 52 which is fixed perpendicularly to this supporting bracket 51 in inverse-L direction against said rope-fixing member 45 and grips the wire rope 20 which is inserted therein.

The lifting angle adjuster 37 of this embodiment is also secured in the middle of said wire rope 20 by fixing above-described rope-fixing member 45 to the wire rope via the fixing jig 48. Thus, in the case of the fixing means 42 just before hooking the load to be lifted, the rope guide member 46 is bent a little upper than the axis $l_1$ of the arm member 40 by the tensile force of the tension spring 47 as shown with the solid line in FIG. 6 and FIG. 7, and the wire rope 20 which is hung from the top end of rope guide member 46 is put to the outdside of the rotation shaft and further the outdside of the periphery of the load 33 to be lifted.

Then, as the rope guide member 46 is rotated, with the rotation shaft 44 being a center and bent inside as shown with the two-dot chain line in FIG. 6 and FIG. 8, the top end of rope guide member 46 is put inside of the periphery of load 33 to be lifted, and the wire rope 20 which passed through from the rope-fixing member 45 to the inner part of the rope guide member 46 is bound around the load 33 to be lifted at its side end portion which is the lifting position thereof. In addition, the number 53 shows a stopper which is provided to the arm member 40 so as to prevent said rope guide member 46 from swinging over the predetermined amount.

Figure 9:
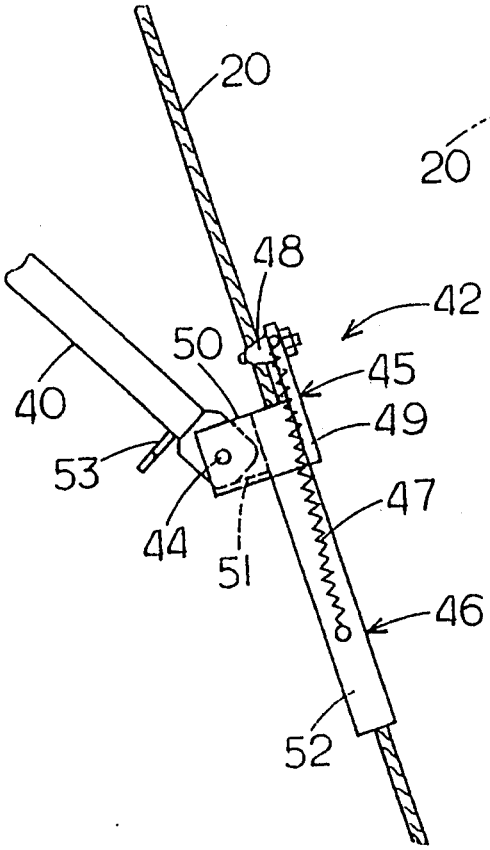
FIG. 9 is a partially enlarged side view showing the state of said fixing means at the of lifting.

When the hooking work of the wire rope 20 is completed, the crane hook 34 is lifted to start lifting. By the action to lift the crane hook 34, the opening angle between the arm members 40 is decreased and, according to the lifting angle, the wire rope 20 coincides with the line connecting the load 33 to be lifted and the crane hook 34. Following such a change in the opening angle between the arm members 40, the rope-fixing member 45 and the rope guide member 46 rotate, with the rotation shaft 44 as a center. FIG. 9 is a partial structural view showing that state.

When the load 33 to be lifted is transported to the predetermined place, and the crane hook 34 is lowered, and the wire rope 20 loses the lifting force, the opening angle between the arm members 40 is increased by the driving force of the expanding driving means 38. Accompanying this action, the rope guide member 46 is bent outside, that is, to the state shown with the solid line in FIG. 6 and FIG. 8 by the force of tension spring 47, and then the wire rope 20 comes off automatically from the load 33 to be lifted. The hitching jigs 54 and 55 for hitching the tension spring 47 are, therefore, to be disposed at the end portion of rope-fixing member 45 and the rope guide member 46 respectively so that a rotating force may be generated, with the rotation shaft 44 as a supporting point.

In the embodiments described above, it is an effective practice to provide a slit groove for guiding the wire rope 20 to the rope guide members 24 and 46

Then, referring to FIGS. from 10 through 14, details will be explained on an automatic lifting angle adjuster for lifting wire rope (referred to simply as a lifting angle adjuster hereinbelow) relating to the third embodimemt of this invention. In FIGS. from 10 through 12, the number 56 shows a lifting angle adjuster, and this lifting angle adjuster 56 comprises a sliding member 57, a receiving member 59 disposed above the sliding member 57 via a compression spring 58, an expanding driving means which is disposed through and supported by the shaft center of the sliding member 57 and the receiving member 59 and which is provided with a vertical shaft 60 for supporting said compression spring 58 inserted therein, four arm members 61 each of which is rotatably supported by said sliding member 57, and four linking members 62 each of which connects said receiving member 59 and each of said arm members 61.

Figure 13:
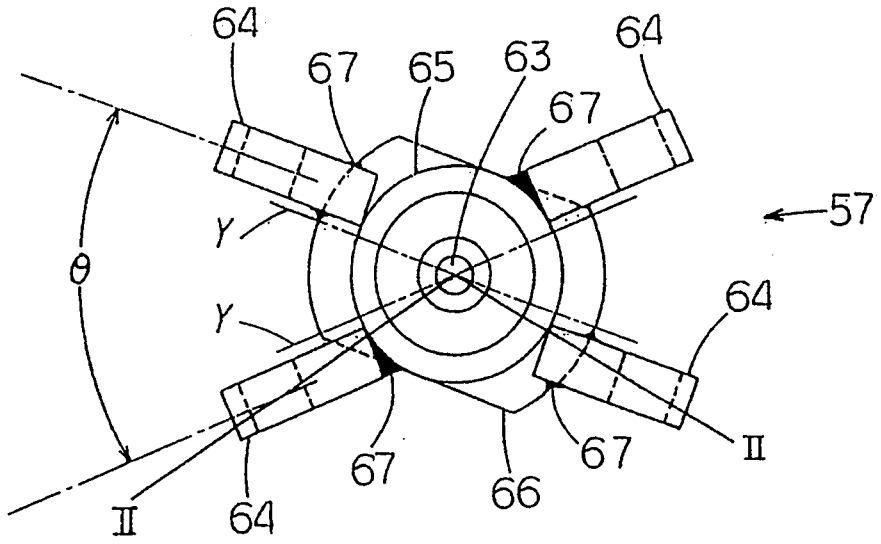
FIG. 13 is an enlarged plan view of the receiving member which is used in said embodiment.
Figure 14:
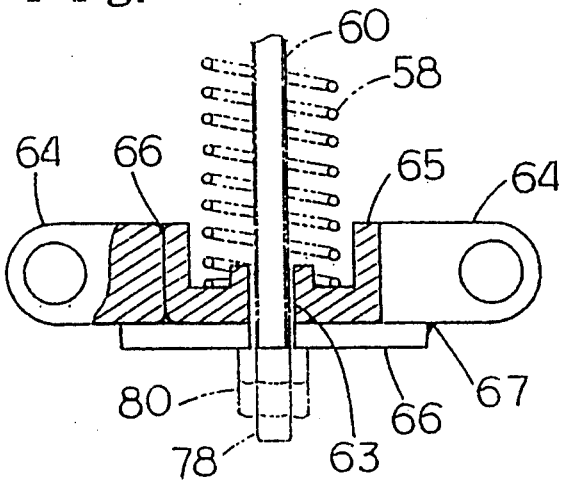
FIG. 14 is a sectional view on line II—II of FIG. 13.

The sliding member 57, as shown in the plan view FIG. 13 and the sectional view (sectional view on the line II—II of FIG. 13) FIG. 14 for example, is provided with a through hole 63 at the center, that is, at the center of shaft and is made up in combination with a bottomed cylindrical member 65 and a plate-shaped member 66 both of which are provided respectively with two lower brackets projecting radially in two directions. In other words, the members 65 and 66 are rotatably combined, with the vertical shaft 60 which is disposed through said through hole 63 and held therein being a base shaft, and the opening angle $\theta$ between the lower brackets 64 can be adjusted to any extent by rotating the members 65 and 66 by the intended angle.

Figure 15:
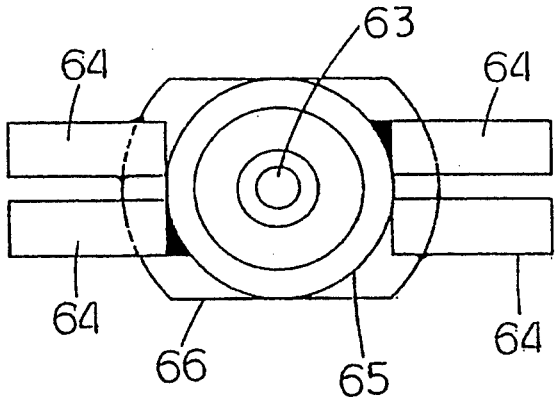
FIG. 15 is an enlarged plan view of the receiving member which is used in said embodiment.
Figure 16:
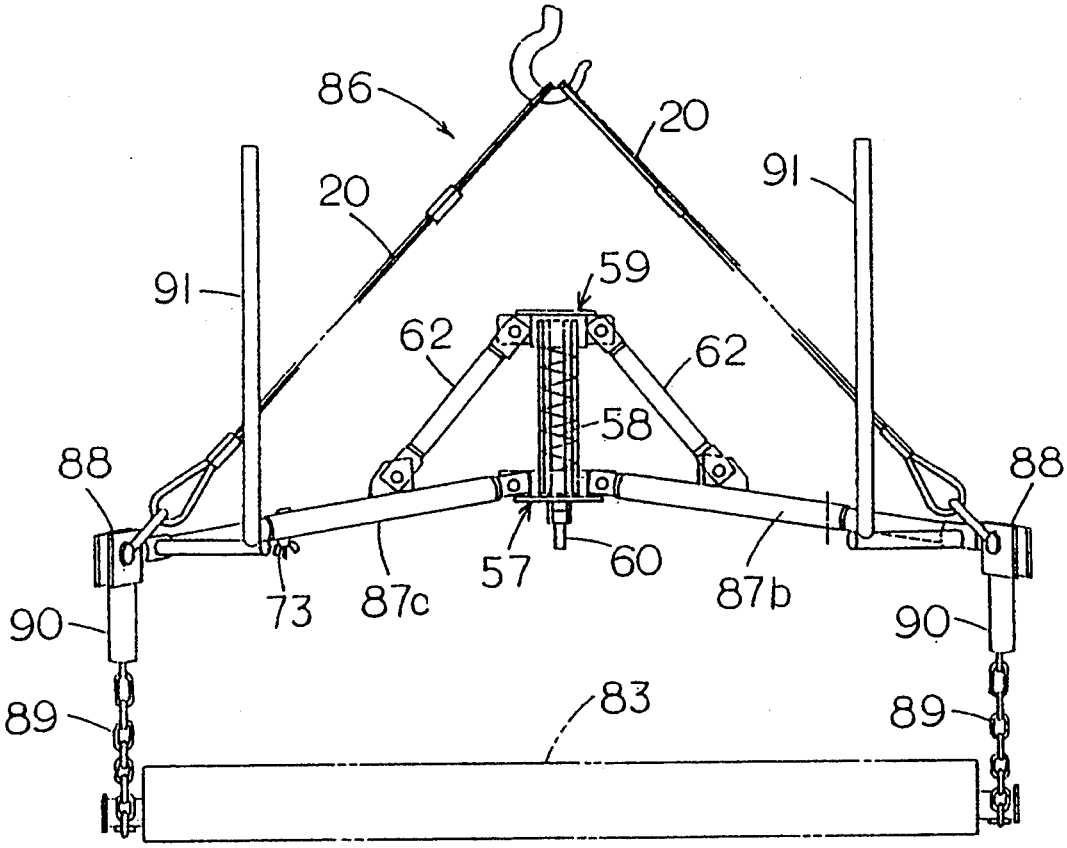
FIG. 16 is a front view of the automatic lifting angle adjuster for lifting wire rope relating to the fourth embodiment of this invention.
Figure 17:
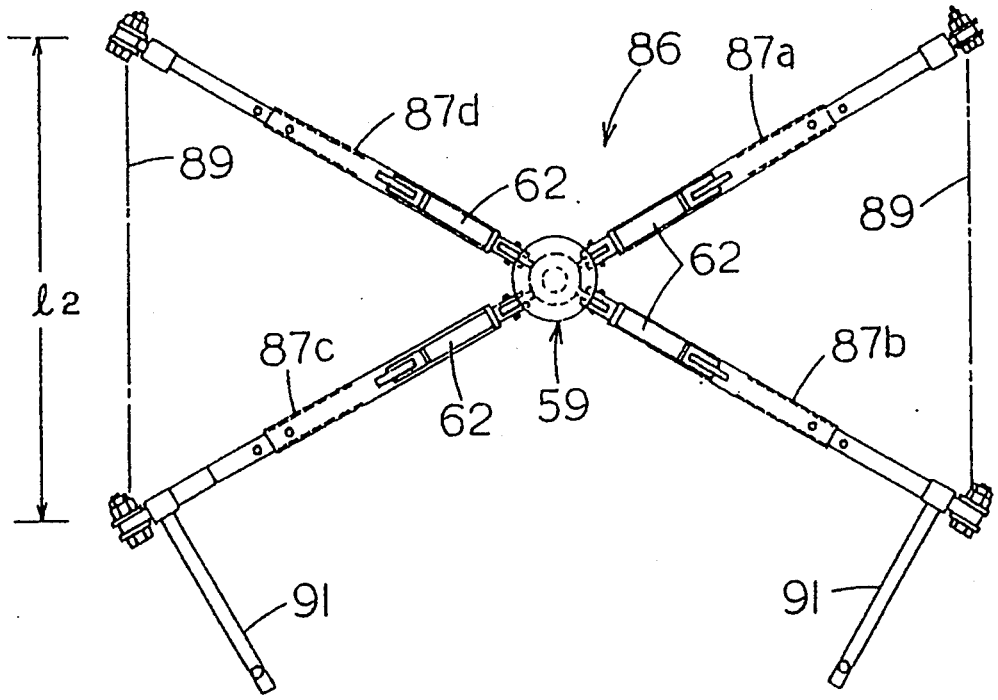
FIG. 17 is a plan view of the same.

Here, the opening angle $\theta$ between lower brackets 64 can be reduced to the limit as shown in FIG. 15 by disposing the lower brackets 64 which are to be attached to the members 65 and 66 by welding 67, etc. in nearly parallel with the axis y of the arm member. Since the opening angle $\theta$ between lower brackets 64 can be reduced, the lifting angle adjuster 56 can be made smaller in shape in case of not being used, and this brings an effect to save the storing space, etc..

By each of said lower brackets 64, each of the arm members 61 is rotatably supported via a pin 68. At the top end of this arm member 61, there is provided a fixing means 69 for fixing the wire rope 20 (the hooking wire rope).

Each of the arm members 61 of the present embodiment comprises an outer pipe 70 whose base end is supported by each of said lower brackets 64 and an inner pipe 71 which is provided with said fixing means 69 at its top end, and the outer pipe 70 and the inner pipe 71 are provided with equally-spaced through holes 72. Accordingly, the pipes can be adjusted to any intended length by inserting the fixing pin 73 into said through hole 72 and fixing it there, with the distance between the supporting pin 68 and the fixing means 69 being set at the predetermined length. The fixing means 69 is rotatably attached to the top end of each of the arm members 61 via a pin 74 and is provided with a clip 75 for fixing the wire rope 20.

To the receiving member 59 which is disposed above said sliding member 57 via the compression spring 58, there is provided an upper bracket 76 which is disposed in the same direction of the lower brackets 64 attached to said sliding member 57, and this upper bracket 76 holds, at its center portion, said vertical shaft 60 which is diposed through and supported by the sliding member 57. For this receiving member 59, the members 65 and 66 which compose the sliding member 57 as shown in FIG. 13 and FIG. 14 can be used in upside-down position.

The compression spring 58 is helically inserted in and held by the vertical shaft 60 disposed between the sliding member 57 and the receiving member 59, and this compression spring 58 is disposed as it is held between the sliding member 57 and the receiving member 59.

The vertical shaft 60 is provided with an overhanging flange 77 for example at its head, with a thread 78 at its tail end, and is engaged with a nut 80 at the tail while piercing the through hole 79 provided at the center of the receiving member 59 and the through hole 63 provided at the center of the sliding member 57.

The compression spring 58 is held between the sliding member 57 and the receiving member 59 as described above and, by adjusting the engaging position of the nut 80, the distance between said overhanging flange 77 and the nut 80 is adjusted and, as a result, the initial spring force of the compression spring 58 is controlled. That is, the overhanging flange 77 and the nut 80 play a role as a stopper for the vertical shaft 60 which is disposed through and held by the sliding member 57 and the receiving member 59. The top end of each linking member 62 is connected to each of the upper brackets 76 of said receiving member 59 via a pin 81, and the tail end thereof is connected to the predetermined position of each of said am members 61 via a pin 82.

Then, the mechanism of said lifting angle adjuster 56 will be detailed hereinbelow according to said FIGS. 10 and 11. As described above, this embodiment shows a hooking work for a box roll 83 for rolling mill as a load to be lifted, and the box roll 83 is provided with lifting pins 84 each of which is projecting. At the tail end of each wire rope 20, there is formed a hook 85 for hitching each of said lifting pin 84. Nearly in the middle of four wire ropes 20 which are hung from the crane hook 34, the fixing means 69 of the lifting angle adjuster 56 are fixed and, via these fixing means 69, the lifting angle adjuster 56 is secured to the wire ropes 20.

Figure 10:
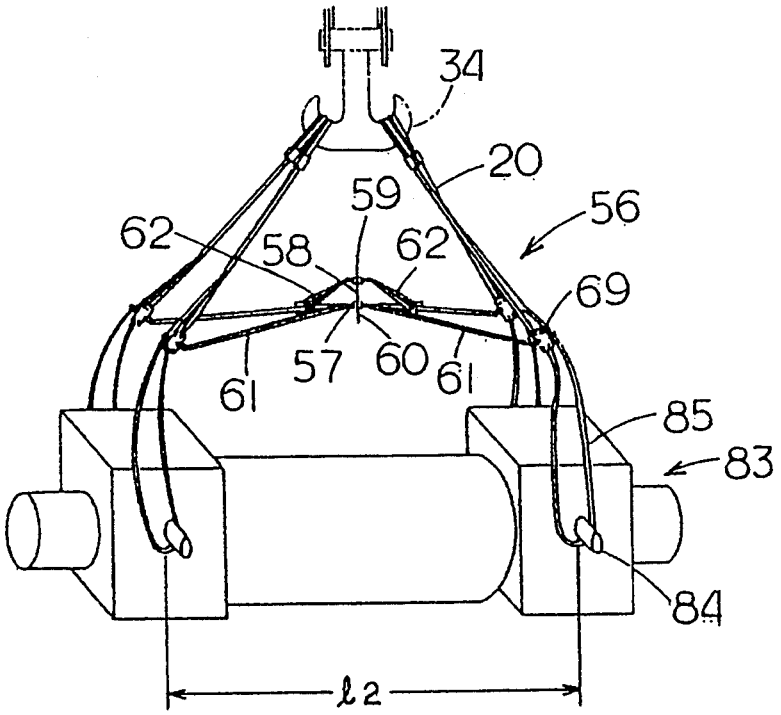
FIG. 10 and FIG. 11 are perspective views of the automatic lifting angle adjuster for lifting wire rope relating to the third embodiment.
Figure 11:
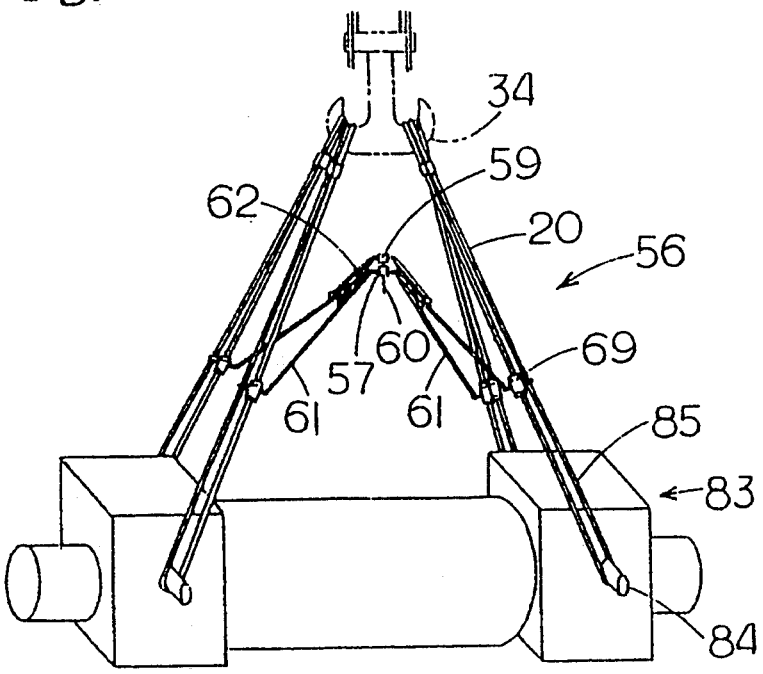
Figure 12:
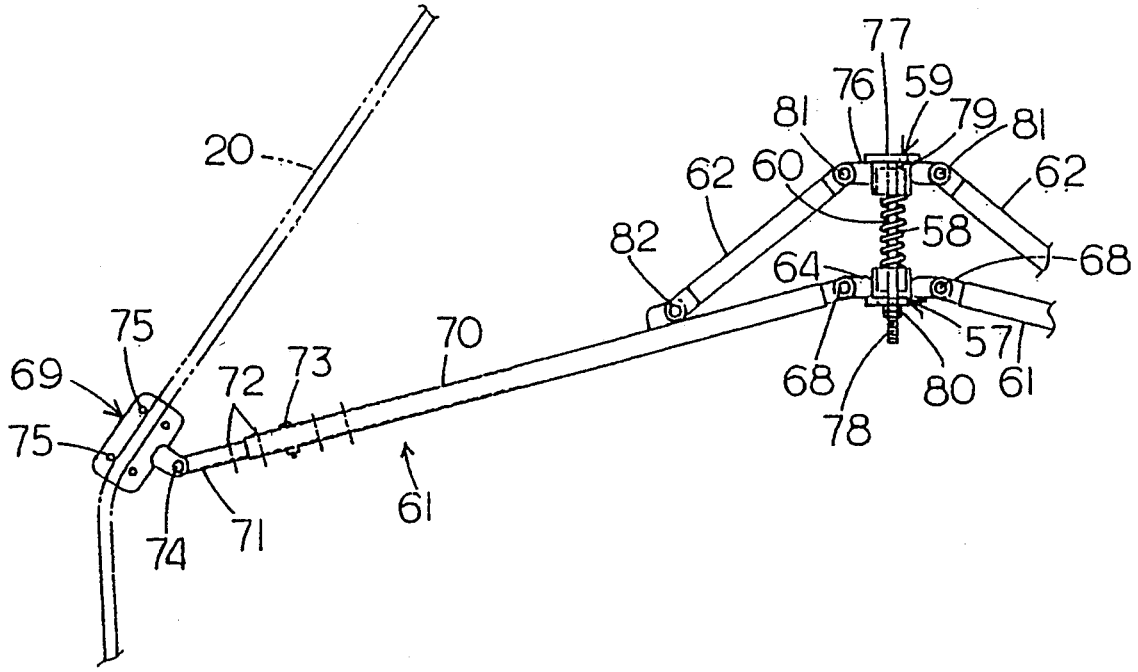
FIG. 12 is a partially enlarged front view of the same.

Then, the lifting angle adjuster 56 secured to the wire ropes 20 keeps such a state that the sliding member 57 and the receiving member 59 are separated by the initial spring force of the compression spring 58 as shown in FIG. 10, and the arm members 61 are expanded to the limit by the function of the linking members 62. By adjusting beforehand the length of the arm members 61 so that the distance $l_2$ between the wire ropes 20 which are hung from the fixing member 69 may be the same as that between the lifting pins 84 of said box roll 83, the hooks 85 of the wire ropes 20 come just to the position of pins 84 of the box roll 83 only by lifting up the wire ropes 20 to which the lifting angle adjuster 56 is secured above the box roll 83 and, thus, the hooks 85 become easy to hitch the lifting pins 84. Then the wire ropes 20 are stretched when the crane hook 34 is lifted up gradually after the hooks 85 have been hitched to the lifting pins 84 and, accompanying this action, the arm members 61 bend as shown in FIG. 11, and the lifting load of the box roll 83 is applied only to the wire ropes 20. That is, by the bending of the arm members 61, the compression spring 58 is compressed and, accompanying the compression, the spring force increases, however the force larger than this spring force is not applied to the arm members 61, the linking member 62, etc. By this mechanism, it is possible to make up the lifting angle adjuster 56 with relatively small members and, as a result, the device becomes small in size and light in weight.

When the box roll 83 after being transported is put to the predetermined place by lowering the crane hook 34, the arm members 61 is expanded to the state as shown in FIG. 10 by the spring force of said compression spring 58, and the hooks 85 of the wire ropes 20 become easy to remove from the lifting pins 84 of the box roll 83.

The FIGS. from 16 through 18 show an automatic lifting angle adjuster for lifting wire rope (simply referred to as a lifting angle adjuster hereinbelow) as the example of the fourth embodimemt of this invention, that is, a lifting angle adjuster 86 which is effective to a load to be lifted whose hooking position (equivalent to $l_2$ in FIG. 10) varies.

Here, the same component members of the lifting angle adjuster 56 relating to said third embodiment are given the same reference numbers as those in said embodiment, and the detailed explanation thereof is omitted.

In the case of the lifting angle adjuster 86 of this embodiment, the hooking wire rope 20 is secured to a fixing means 88 provided at each top end of four arm members 87*a* through 87*d*, and the top ends of the facing pairs of arm members 87*a* and 87*b*, and the arm members 87*c* and 87*d* are connected each other with a lifting rope 89 such as a wire rope or a chain via said fixing means 88. And, to this fixing member 88 provided at each top end of the arm members 87*a* through 87*d*, a guide member 90 for guiding said lifting rope 89 is swingably attached. It is effective for making efficiently a lifting space with the lifting ropes 89 to provide, for example, a stopper to the fixing member 88 for preventing said guide member 90 from bending inside over the predetermined angle. Since the lifting ropes 89 thus make a large arc, it is easy to adjust said lifting space by providing for example a handle 91 to each of said facing pairs of arm members 87*b* and 87*c*, and by rotating the members 87*a* through 87*d* around the vertical shaft 60 by use of the handle 91.

The lifting angle adjuster 86 of this embodiment having the function described above is especially effective for a load to be lifted whose size or hooking position varies, which is too hot for a hooking worker to touch by his hand, which can be hooked only from one side, or which requires a repeating hooking work, improving the work efficiency and reducing largely the burden of the hooking workers.

Figure 18:
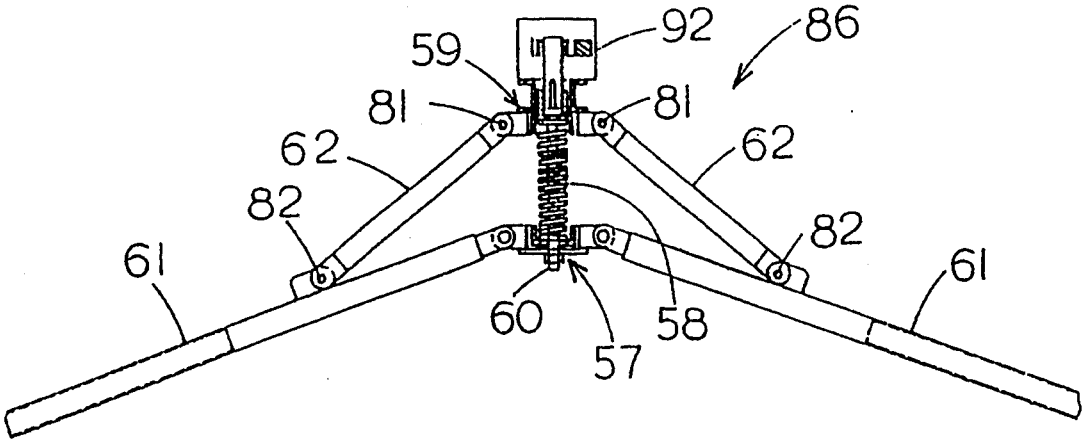
FIG. 18 is a partial plan view of the automatic lifting angle adjuster for lifting wire rope, a part of which is modified, relating to said fourth embodiment.

Accordingly, it is an effective practice for obtaining an efficient rotation of said arm members 87*a* through 87*d* to provide a rotating driving device 92 shown in FIG. 18 for example and having a motor whose inside is not shown to said vertical shaft 60. That is, the outer casing of said rotating driving device 92 is attached to a plate-shaped member of the receiving member 59 to which the facing upper brackets of one side are attached, the output shaft of the rotating driving device 92 is fixed to the vertical shaft 60, and this vertical shaft 60 is fixed to a bottomed cylindrical member to which the facing upper brackets of the other side are attached. Thus, the opening angle $\theta$ shown in said FIG. 13 can be adjusted without troubling a hooking worker by rotating the rotating driving device 92, for example, via a remote control from the operator's cab of the crane.

In the embodiment shown in said FIG. 18, the rotating driving device 92 is fixed to the receiving member 59 and the sliding member 57 is rotated via the vertical shaft 60, it is, on the other hand, also possible to change the angle between the members 65 and 66 by use of the rotating driving device 92 by attaching it to the sliding member 57.

Figure 19:
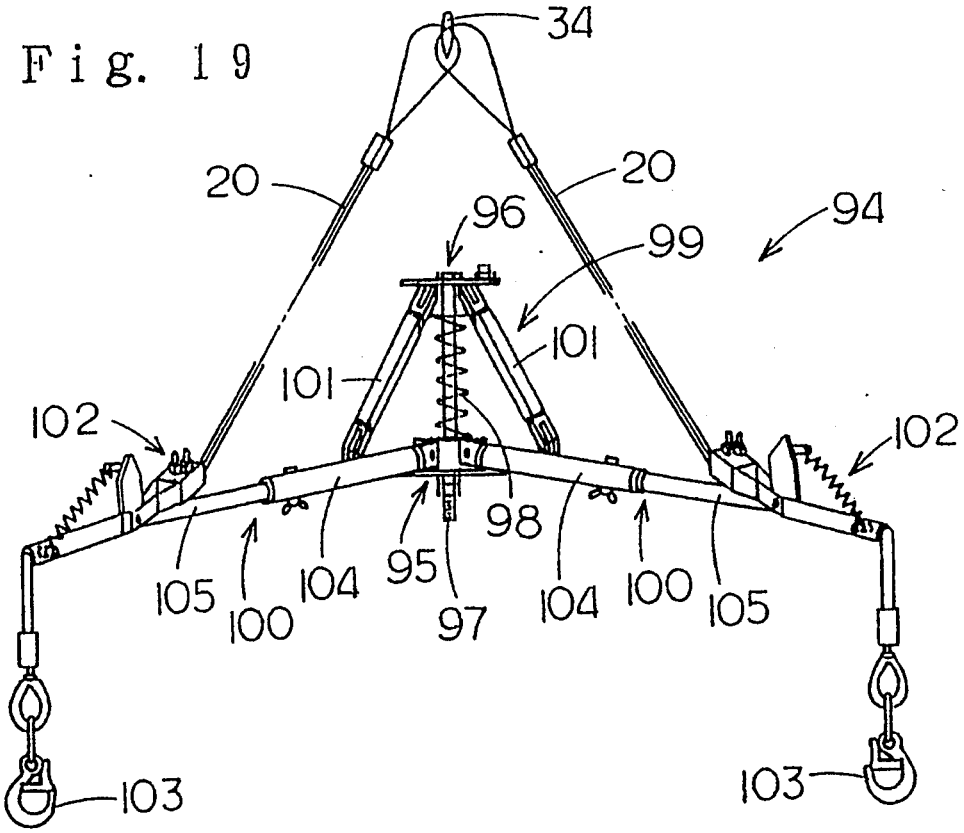
FIG. 19 is a front view of the automatic lifting angle adjuster for lifting wire rope relating to the fifth embodiment of this invention.
Figure 20:
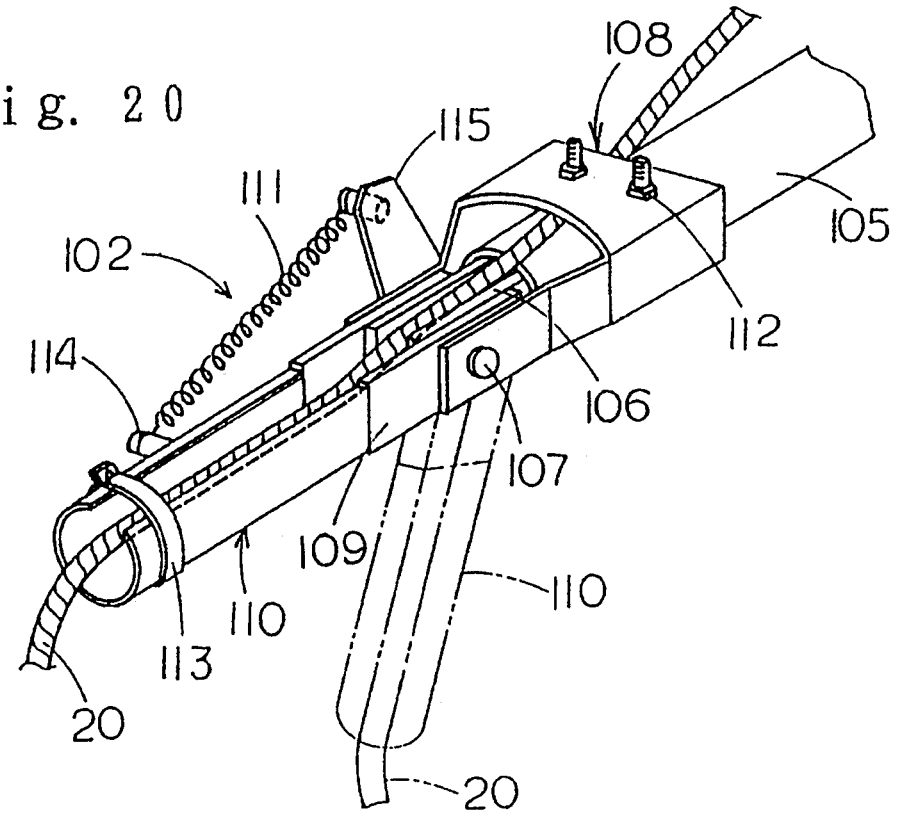
FIG. 20 is a partial perspective view of the same.

The FIGS. 19 and 20 show an automatic lifting angle adjuster for lifting wire rope (simply referred to as a lifting angle adjuster hereinbelow) as the example of the fifth embodimemt of this invention and, as shown in the figures, the lifting angle adjuster 94 of this embodiment comprises, an expanding driving means 99 which is provided with a sliding member 95 disposed at the bottom, a receiving member 96 disposed at the top, a vertical shaft 97 which connects these members, and a compression spring 98 which is mounted on the vertical shaft 97 as same as of said expanding driving means 11, four arm members 100 which are radially connected to the expanding driving means 99, linking members 101, and fixing means 102 each of which fixes each wire rope 20 whose top end is hitched to the crane hook 34 to the top end of each arm member 100.

To each of said fixing means 102, a lifting hook 103 is attached via each wire rope 20 and, from here, if necessary, two pairs of wire ropes, clamps, etc. not shown in the figure can be hung so as to connect the facing lifting hooks 103.

As same as in the third embodiment, each of said arm members 100 is provided with an outer pipe 104 and an inner pipe 105 which are telescopically connected and a fitting metal 106 which is fixed at the top end portion of the inner pipe 105. And, to the fitting metal 106, said fixing means 102 is rotatably attached.

Said fixing means 102 comprises a rotation shaft 107 which is attached horizontally to the fitting metal 106, a rope-fixing member 108 which is rotatably supported by the rotation shaft 107, a rope guide member 110 having a supporting bracket 109 which is supported by the rotation shaft 107, rotating under said rope-fixing member 108, and being fixed in the inverse direction of said rope-fixing member 108, and a tension spring 111 both ends of which are hitched at the top portions of said rope-fixing member 110 and the rope guide member 108 respectively.

Said rope-fixing member 108 is of open-bottom box type having a fixing jig 112 which is composed of wire clip, etc. on the top thereof so as to grip said wire rope 20 at the end portion thereof. And said rope guide member 110 is of open-top box type having a band 113 at the top portion thereof for preventing the wire rope 20 from coming off.

Moreover, the rope guide member 110 and the rope-fixing member 108 are provided with a hitching jig 114 and a hitching jig 115 respectively, and said tension spring 111 having a predetermined tension is stretched between these hitching jigs 114 and 115 so as to rotate and secure said rope guide member 110 upwards or downwards from the rope-fixing member 108. In addition, the tension spring 111, taking into account the weight of the lifting hook 103, wire rope, etc. which are hung via said rope guide member 110, is disposed nearly in the extension line of said arm member 100, and its tension is so adjusted that the rope guide member 100 may rotate as shown by the two-dot chain line in FIG. 20, with the rotation shaft 107 being a supporting point, when the top end of the rope guide member 110 is pulled downwards by the hooking worker.

Therefore, in case of using this lifting angle adjuster 94, the facing lifting hooks 103 are connected by use of two pairs of wire ropes having predetermined length for example, the arm members 100 are adjusted to proper length, and the lifting angle adjuster 94 is lowered to the predetermined height by lowering the crane hook 34. Then, by rotating downwards a pair of rope guide members 110 from which one pair of wire ropes is hung, with the rotation shaft 107 being a center, one pair of wire ropes hung from said lifting hooks 103 is moved centerwards to be hooked to one side of a load to be lifted, and then, by rotating downwards said rope guide member 110 which is a facing pair as same as explained above, the other pair of wire ropes which is hung from the lifting hook 103 is hooked to the other side of the load to be lifted. In this case, because each of the rope guide members 110 is held as it is by the tensile force of said tension spring 111 when it is rotated downwards over the predetermined angle, with the rotation shaft 107 being a supporting point, it is possible for one hooking worker to hook the wire ropes to a load to be lifted by pulling downwards one by one said rope guide members 110.

After these works, by lifting the crane hook 34, the load to be lifted can be lifted by the wire ropes 20 which are hung from said lifting hooks 103. At this time, the rope guide member 110 rotates upwards, and the tension spring 111 comes above the rotation shaft 107 because said wire ropes 20 become straight and, when the wire ropes 20 lose the lifting force after the load has been transported to the predetermined place and the crane hook 34 has been lowed, the arm members 100 are expanded by the force of compression spring 98 disposed at the center, and said lower pairs of wire ropes come off automatically from the load after transported.

Though another wire rope is hung from each lifting hook 103 in aforesaid fifth embodiment, it is possible to use a chain or a clamp holding a steel plate, etc. in place of said wire rope.

Further, this invention is of course applicable to an automatic lifting angle adjuster for lifting wire rope comprising said third or fourth embodiment and the first, the second, or the fifth embodiment in combination thereof.

INDUSTRIAL APPLICABILITY

In the case of the automatic lifting angle adjuster for lifting wire rope relating to the first and the second invention, the hooking work can easily be carried out only by rotating or swinging the rope guide member with a little force even if a load to be lifted is large and heavy. And, the wire ropes come off automatically when a transportation is over completely without troubling a hooking worker. This makes the attaching and detaching of heavy wire rope, that is, a hooking work be carried out by a few hooking workers with enough efficiency and safety.

In the case of the automatic lifting angle adjuster for lifting wire rope relating to the third invention, it is possible to decrease the total height of the device because the vertical shaft which supports the compression spring is disposed projecting over the sliding member, and the device therefore has the advantages that the height from the crane hook to a load to be lifted can be reduced, the length of wire ropes to be used can be saved, and the lift of the load to be lifted can be increased.

Furthermore, because of its simple construction, the automatic lifting angle adjuster for lifting wire rope of this invention is light in weight, low in the manufacturing cost, and extremely easy to handle; allowing an efficient and safe hooking work by a few hooking workers.

We claim:

1. An automatic lifting angle adjuster for lifting wire rope, comprising:

an expanding driving means disposed at a center of the automatic lifting adjuster;

four arm members radially connected to said expanding driving means;

fixing means of which is placed at the top end portion of each of the arm members so as to fix the lifting wire rope, by which the opening lateral angle between the arm members is increased at the time of hooking work and the opening lateral angle between the arm members is decreased at the time of lifting, wherein said expanding driving means comprises:

a sliding member having four lower brackets to each of which a base end of each said radially-projecting arm member is attached so that it may rotate along a vertical surface thereof while holding a vertical shaft at the center thereof;

a receiving member having four upper brackets each of which rotates around said vertical shaft so as to be in the same direction as that of each counterpart of the four lower brackets which are attached to said sliding member, holding said vertical shaft at the center thereof and, at the same time, being disposed above said sliding member via a compression spring inserted through and held by the vertical shaft; and linking member which connects each of the upper brackets of said receiving member and each of said arm members at a predetermined position, wherein said four lower brackets are attached in pairs to members which are independently rotatably attached to said vertical shaft and wherein said brackets in each said pair of brackets are located on opposite sides of said vertical shaft such that adjustment of the opening lateral angle between each of the arm attached to each corresponding bracket is adjustable by a lateral movement of only one of said arms.

2. An automatic lifting angle adjuster for lifting wire rope according to claim 1 wherein the sliding member or the receiving member is provided with a rotating driving device so as to control the opening angle between the arm members.

3. An automatic lifting angle adjuster for lifting wire rope according to claim 1 or 2 wherein the fixing means secured on a pair of the arm members are connected with a lifting rope and, to each of the fixing means, a guide member of said lifting rope is swingably attached.

* * * * *

UNITED STATES PATENT AND TRADEMARK OFFICE

CERTIFICATE OF CORRECTION

PATENT NO. : 5,342,104

DATED : August 30, 1994

INVENTOR(S) : Sato et al.

It is certified that error appears in the above-indentified patent and that said Letters Patent is hereby corrected as shown below:

On the cover page, Item [30], line 1, "Oct. 16, 1989" should read --Oct. 18, 1989--.

Signed and Sealed this

Twenty-second Day of November, 1994

*Attest:*

Bruce Lehman

BRUCE LEHMAN

*Attesting Officer*

*Commissioner of Patents and Trademarks*